US011933525B2

(12) United States Patent
Araki et al.

(10) Patent No.: US 11,933,525 B2
(45) Date of Patent: Mar. 19, 2024

(54) LIQUID RECEIVER, AND VEHICLE-USE AIR CONDITIONING DEVICE CONDENSER INCLUDING THE LIQUID RECEIVER

(71) Applicant: Valeo Japan Co., Ltd., Saitama (JP)

(72) Inventors: Daisuke Araki, Saitama (JP); Noriaki Nemoto, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 168 days.

(21) Appl. No.: 17/687,173

(22) Filed: Mar. 4, 2022

(65) Prior Publication Data

US 2022/0282894 A1 Sep. 8, 2022

(51) Int. Cl.
*F25B 39/04* (2006.01)
*F25B 43/00* (2006.01)

(52) U.S. Cl.
CPC ..... *F25B 39/04* (2013.01); *F25B 43/003* (2013.01); *F25B 2339/0441* (2013.01); *F25B 2339/0446* (2013.01); *F25B 2400/162* (2013.01); *F25B 2500/01* (2013.01)

(58) Field of Classification Search
CPC ..... F25B 39/04; F25B 43/003; F25B 2339/0441; F25B 2339/0446; F25B 2400/162; F25B 2500/01; F25B 2500/221; F28D 1/05366; F28F 2220/00; F28F 2275/14
See application file for complete search history.

(56) References Cited

U.S. PATENT DOCUMENTS

2021/0033319 A1* 2/2021 Durbecq ..... F25B 43/003

FOREIGN PATENT DOCUMENTS

JP H09324962 A 12/1997
JP 2000-97524 A 4/2000
JP 2000097524 A * 4/2000

OTHER PUBLICATIONS

Pdf is original document of foreign referecne JP 2000097524-A (Year: 2000).*
Pdf is original document of foreign reference JP 2000097524 A (Year: 2000).*

* cited by examiner

*Primary Examiner* — Len Tran
*Assistant Examiner* — Kamran Tavakoldavani
(74) *Attorney, Agent, or Firm* — Osha Bergman Watanabe & Burton LLP

(57) ABSTRACT

Described is a stopper including a filtering unit housed in an interior of a liquid receiver main body through which a refrigerant passes, a fixed portion that includes a screw portion that is screwed into an inner peripheral face of the liquid receiver main body, a sealing member in contact with the inner peripheral face of the liquid receiver main body, thereby preventing a leakage of a refrigerant to the fixed portion, and a movable connection portion provided between the filtering unit and the fixed portion for linking the filtering unit to the fixed portion in such a way that the filtering unit is not caused to follow a rotation of the fixed portion, and in such a way that the filtering unit is caused to follow an axial direction movement of the fixed portion.

7 Claims, 18 Drawing Sheets

LIQUID RECEIVER, AND VEHICLE-USE AIR CONDITIONING DEVICE CONDENSER INCLUDING THE LIQUID RECEIVER

BACKGROUND OF THE INVENTION

1. Field of the Invention

The present invention relates to a liquid receiver that is provided on an exit side of a refrigerating cycle condenser and temporarily stores a liquefied liquid refrigerant, and to a vehicle-use air conditioning device condenser that includes the liquid receiver.

2. Description of the Related Art

There are cases wherein a liquid receiver that separates a gas/liquid mixture refrigerant condensed in the condenser into a gas and a liquid, and temporarily stores the liquid refrigerant, is provided on the exit side of a refrigerating cycle condenser. A liquid receiver disclosed in Patent Literature 1 has a cylindrical liquid receiver main body, and an aperture portion provided in one longitudinal direction side end portion (bottom portion) and a stopper (plug) that blocks off the aperture portion are included in the liquid receiver main body. An internal thread is formed on an inner peripheral face of the liquid receiver main body, an external thread is formed on an outer peripheral face of the stopper, and the stopper is inserted through the aperture portion of the liquid receiver main body and fixed by the external thread being screwed into the internal thread. Also, the stopper has a filter, and is configured in such a way that a refrigerant flowing through the liquid receiver main body can be filtered.

A sealing O-ring is included on the outer peripheral face of the stopper. This means that when an insertion of the stopper is completed, a gap formed by the outer peripheral face of the stopper and the inner peripheral face of the liquid receiver main body is sealed, and a refrigerant leakage is prevented.

However, a sealing structure of this kind of stopper is such that when the stopper is mounted, the stopper is inserted while rotating while a state wherein the O-ring is compressed between the stopper and the liquid receiver main body is maintained, because of which there is concern that the O-ring will be damaged or that uneven distortion in a circumferential direction will occur in the O-ring. Because of this, sufficient consideration is necessary at a time of production to ensure that this does not lead to a refrigerant leakage.

Herein, a kind of liquid receiver disclosed in Patent Literature 2 has been proposed. While a stopper is the same as the stopper of Patent Literature 1 in that an O-ring is included, a fixing screw hole is provided in a side face instead of the external thread. Also, a supporting hole is provided in a corresponding side face of a liquid receiver main body.

The liquid receiver disclosed in Patent Literature 2 is such that the stopper is inserted without being caused to rotate in a longitudinal direction of the liquid receiver main body, and after the insertion is finished, a fixing screw can be passed through the supporting hole of the liquid receiver main body and screwed into the fixing screw hole of the stopper. According to this kind of configuration, there is no need to screw the stopper into the liquid receiver main body (there is no need for the stopper to move in an axial direction while rotating), the O-ring is simply pressed in in the axial direction of the liquid receiver main body, and concern that the O-ring will be damaged or the like can be reduced.

Patent Literature 1: JP-A-9-324962

Patent Literature 2: JP-A-2000-97524

However, the configuration of Patent Literature 2 is such that after the stopper is inserted into the liquid receiver main body, work of passing the fixing screw through the supporting hole of the liquid receiver main body and screwing the fixing screw into the fixing screw hole of the stopper is necessary. Also, fixing of the stopper is carried out using a fixing screw that is mounted in a direction perpendicular to the longitudinal direction of the liquid receiver main body, and there is concern that the stopper will be subjected to refrigerant pressure and move, leading to a refrigerant leak. That is, the process of fixing the stopper using a fixing screw is such that it is necessary not only to pass the fixing screw through the supporting hole of the liquid receiver main body and screw the fixing screw into the fixing screw hole of the stopper, but also to fix the fixing screw securely in order to prevent a refrigerant leakage, and there is room for improvement in terms of improving productivity.

SUMMARY OF THE INVENTION

The present invention has been contrived in consideration of such circumstances, and has main objects of providing a liquid receiver wherein a longitudinal direction aperture portion of a liquid receiver main body is blocked off by a stopper, and a securing of airtightness for preventing a refrigerant leak and an improvement in stopper attachment productivity are achieved, and of providing a vehicle-use air conditioning device condenser that includes the liquid receiver.

In order to achieve the heretofore described objects, a liquid receiver according to the present invention is a liquid receiver 1 having a liquid receiver main body 2 that is formed in a tubular form and stores a refrigerant in an interior, and a stopper 4 that is inserted into a one side aperture portion 2*a* provided in a one side end portion in a longitudinal direction of the liquid receiver main body 2, thereby blocking off the one side aperture portion 2*a*, wherein the stopper 4 is characterized by including a filtering unit 41 that is housed in the interior of the liquid receiver main body 2 and through which the refrigerant passes, a fixed portion 42 that includes on an outer peripheral face thereof a screw portion 42*a* that is screwed into an inner peripheral face of the one side aperture portion 2*a* of the liquid receiver main body 2, a sealing member 43 that is brought into contact with an inner peripheral face of the liquid receiver main body 2, thereby preventing a leakage of a refrigerant to the fixed portion from between the filtering unit 41 and the liquid receiver main body 2, and a movable connection portion 44 that is provided between the filtering unit 41 and the fixed portion 42 and links the filtering unit 41 to the fixed portion 42 in such a way that the filtering unit 41 is not caused to follow a rotation of the fixed portion 42, and in such a way that the filtering unit 41 is caused to follow an axial direction movement of the fixed portion 42.

Consequently, when attaching a stopper with which a filtering unit is integrated to a one side aperture portion of a liquid receiver main body, the filtering unit is inserted from the one side aperture portion together with a sealing member and pressed in an axial direction into the liquid receiver main body, after which a screw portion is screwed to an inner peripheral face of the liquid receiver main body by rotating a fixed portion. This kind of attachment process is such that a movable connection portion provided between the filtering unit and the fixed portion does not cause the filtering unit to follow a rotation of the fixed portion, and causes the filtering unit to follow an axial direction movement of the fixed portion, meaning that when the fixed portion is screwed into the liquid receiver main body, the stopper can be inserted into an aperture portion of the liquid receiver main body without causing the sealing member that is brought into contact with the inner peripheral face of the liquid receiver main body to rotate.

Because of this, there is no problem of the sealing member being damaged, and there is no occurrence of uneven distortion in a circumferential direction in the sealing member, because of which high airtightness provided by the sealing member can be secured. Also, as the stopper is fixed by an internal thread of the liquid receiver main body and an external thread of the stopper being screwed together, productivity of attaching the stopper to the liquid receiver can be improved.

Herein, it is good when the filtering unit 41 is an injection molded article, and has a bearing face 41*e* that supports the sealing member 43, and the bearing face 41*e* is formed in a position deviating from a partitioning line P of dies 51, 52, and 53 that mold the filtering unit 41.

This kind of configuration is such that as a bearing face supporting a sealing member is formed in a position deviating from a partitioning line, burr or the like is not formed on the bearing face, there is no longer a problem of the sealing member being damaged, there is no longer a problem of a form of the sealing member becoming distorted or the like, and a high sealing performance can be maintained.

Also, a configuration may be such that the stopper 4 has an intermediate portion 60 between the filtering unit 41 and the fixed portion 42, the intermediate portion 60 is fixed with respect to the filtering unit 41 and is linked to the fixed portion 42 via the movable connection portion 44, and the sealing member 43 is provided between the filtering unit 41 and the intermediate portion 60.

This kind of configuration is such that as a sealing member that is brought into contact with an inner peripheral face of the liquid receiver main body 2 is provided between a filtering unit and an intermediate portion, a rotational force of a fixed portion no longer acts at all on the sealing member, a problem of the sealing member being damaged and a problem of an uneven distortion occurring in the sealing member can be more reliably restricted, and a high airtightness can be secured.

Herein, a configuration may be such that the stopper 4 further includes another sealing member 61 that is brought into contact with the inner peripheral face of the liquid receiver main body 2, thereby preventing a leakage of a refrigerant to the fixed portion 42 from between the intermediate portion 60 and the liquid receiver main body 2, and the other sealing member 61 is provided between the intermediate portion 60 and the fixed portion 42.

This kind of configuration is such that as two sealing members are provided in an axial direction of a stopper, a sealing effect can be further increased.

In this case too, it is good when the intermediate portion 60 is an injection molded article, and has a bearing face 60*b* that supports the sealing member 43 and another bearing face 60*c* that supports the other sealing member 61, and the bearing face 60*b* and the other bearing face 60*c* are formed in positions deviating from a partitioning line P of dies 71 and 72 that mold the intermediate portion 60.

As bearing faces provided in an intermediate portion to support two sealing members are formed in positions deviating from a partitioning line, no burr or the like is formed on the bearing faces, and a high sealing performance can be secured.

Also, a configuration may be such that the sealing member 43 comes into contact with a stepped portion 2*e* formed on the inner peripheral face of the liquid receiver main body 2, and is compressed in an axial direction.

This kind of configuration is such that as a sealing member can be compressed in an axial direction, a higher sealing performance can be secured.

Herein, the stepped portion 2*e* may be configured to have a tapered face.

The heretofore described liquid receiver is suitable for use in a condenser 100 of a vehicle-use air conditioning device wherein a refrigerant leak needs to be reliably restricted even when used in a vibrating environment.

According to the present invention, as heretofore described, a liquid receiver wherein a longitudinal direction aperture portion of a liquid receiver main body is blocked off by a stopper, and a securing of airtightness for preventing a refrigerant leak and an improvement in stopper attachment productivity are achieved, can be provided, and a vehicle-use air conditioning device condenser that includes the liquid receiver can be provided.

BRIEF DESCRIPTION OF THE DRAWINGS

FIGS. 3A-3B are drawings showing a stopper used in the liquid receiver, wherein FIG. 3A is a sectional view cut along a plane including an axial line of the stopper, and FIG. 3B is a drawing showing a cross-section that has been rotated 90 degrees centered on the axial line of the stopper;

FIGS. 4A-4B are drawings wherein components of the stopper of FIGS. 3A-3B have been disassembled, wherein FIG. 4A is a sectional view cut along the same plane as in FIG. 3A, and FIG. 4B is a sectional view cut along the same plane as in FIG. 3B;

FIGS. 5A-5B are drawings showing a state before the stopper of FIGS. 3A-3B is attached to a one side aperture portion (a lower side aperture portion) of a liquid receiver main body, wherein FIG. 5A is a sectional view cut along the same plane as in FIG. 3A, and FIG. 5B is a sectional view cut along the same plane as in FIG. 3B;

FIGS. 6A-6B are drawings showing a state wherein the stopper of FIGS. 3A-3B is attached to the one side aperture portion (the lower side aperture portion) of the liquid receiver main body, wherein FIG. 6A is a sectional view cut along the same plane as in FIG. 3A, and FIG. 6B is a sectional view cut along the same plane as in FIG. 3B;

FIGS. 7A-7D are drawings showing a manufacturing process wherein a filtering unit of the stopper and engagement arms of a movable connection portion are molded integrally, and is a sectional view cut along the same plane as in FIG. 3A, wherein FIG. 7A is a drawing showing a state wherein a filter is disposed in a cavity before dies (an upper die, a lower die, and a sliding die) are closed, FIG. 7B is a drawing showing a state wherein the dies have been closed from the state in FIG. 7A and a resin has been injected, FIG. 7C is a drawing showing a state wherein the dies have been opened after the resin injection, and FIG. 7D is a drawing showing a state wherein a product is pressed up by an ejector pin after the dies have been opened;

FIGS. 8A-8D are drawings showing a manufacturing process wherein the filtering unit of the stopper and a fixed side fitting portion of the movable connection portion are molded integrally, and is a sectional view cut along the same plane as in FIG. 3A, wherein FIG. 8A is a drawing showing a state wherein a mesh member is disposed in a cavity before the dies (the upper die, the lower die, and the sliding die) are closed, FIG. 8B is a drawing showing a state wherein the dies have been clamped from the state in FIG. 8A and a resin has been injected, FIG. 8C is a drawing showing a state wherein the dies have been opened after the resin injection, and FIG. 8D is a drawing showing a state wherein a product is pressed up by an ejector pin after the dies have been opened;

FIGS. 10A-10B are drawings showing an example wherein the stopper is configured of the filtering unit, the fixed portion, and an intermediate portion interposed between the filtering unit and the fixed portion, and shows a case wherein a sealing member brought into contact with an inner peripheral face of the liquid receiver main body is provided between the filtering unit and the intermediate portion, wherein FIG. 10A is a sectional view cut along the same plane as in FIG. 6A, and FIG. 10B is a sectional view cut along the same plane as in FIG. 6B;

FIGS. 11A-11B are drawings showing an example wherein the stopper is configured of the filtering unit, the fixed portion, and an intermediate portion interposed between the filtering unit and the fixed portion, and shows a case wherein sealing members brought into contact with the inner peripheral face of the liquid receiver main body are provided between the filtering unit and the intermediate portion, and between the intermediate portion and the fixed portion, wherein FIG. 11A is a sectional view cut along the same plane as in FIG. 6A, and FIG. 11B is a sectional view cut along the same plane as in FIG. 6B;

FIGS. 12A-12D are drawings showing a manufacturing process wherein the intermediate portion is molded, and is a sectional view cut along the same plane as in FIG. 11A, wherein FIG. 12A is a drawing showing a state wherein dies are clamped and filled with a resin, FIG. 12B is a drawing showing a state wherein a core die has been caused to rotate and pulled out from the intermediate portion, FIG. 12C is a drawing showing a state wherein the dies have been opened, and FIG. 12D is a drawing showing a state wherein a product is pressed up by an ejector pin after the dies have been opened;

FIGS. 13A-13B are drawings showing an example wherein a sealing member provided on an outer periphery of the filtering unit of the stopper formed of the filtering unit and the fixed portion is brought into contact with a stepped portion formed on the inner peripheral face of the liquid receiver main body and caused to compress in an axial direction, wherein FIG. 13A is a sectional view cut along the same plane as in FIG. 6A, and FIG. 13B is a sectional view cut along the same plane as in FIG. 6B;

FIGS. 14A-14B are drawings showing an example wherein a sealing member provided on an outer periphery of the filtering unit of the stopper formed of the filtering unit and the fixed portion is brought into contact with a stepped portion formed on the inner peripheral face of the liquid receiver main body and caused to compress in an axial direction, wherein FIG. 14A is a sectional view cut along the same plane as in FIG. 6A, and FIG. 14B is a sectional view cut along the same plane as in FIG. 6B; and FIGS. 15A-15B are drawings showing a configuration example wherein the configuration shown in FIG. 14 further includes a sealing member provided on an outer periphery of the intermediate portion, wherein FIG. 15A is a sectional view cut along the same plane as in FIG. 6A, and FIG. 15B is a sectional view cut along the same plane as in FIG. 6B.

DESCRIPTION OF THE PREFERRED EMBODIMENTS

Hereafter, an embodiment of the present invention will be described, based on the drawings.

Figure 1:
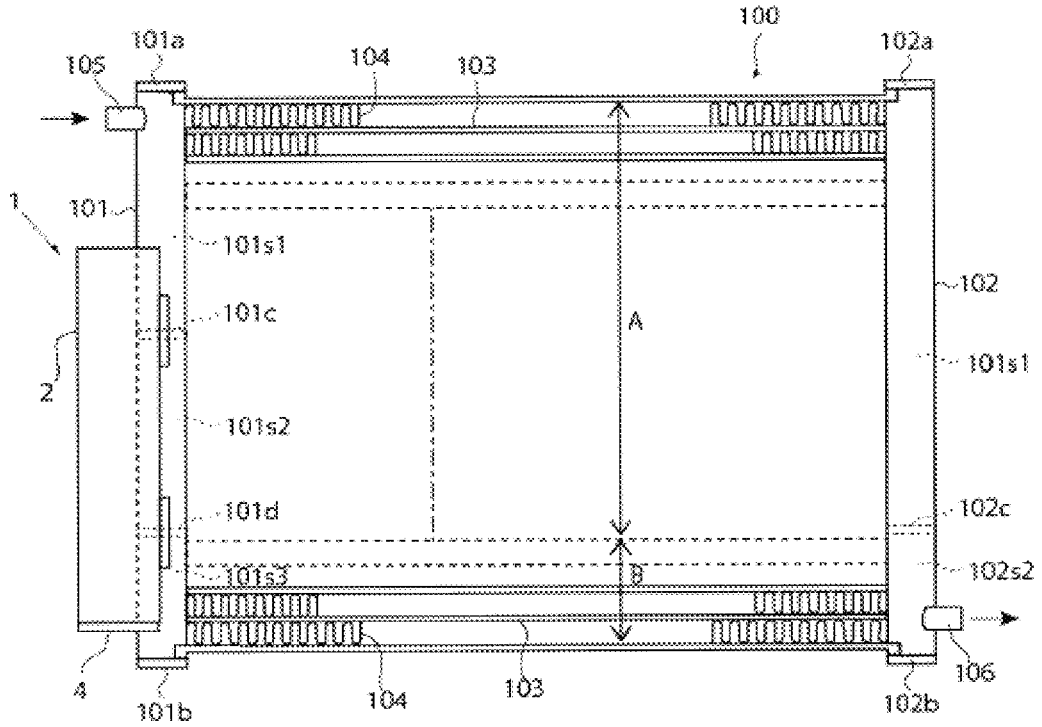
FIG. 1 is a drawing showing a configuration example of a vehicle-use air conditioning device condenser according to the present invention.

A vehicle-use air conditioning device condenser 100 that integrally includes a liquid receiver 1 according to the present invention is shown in FIG. 1. The vehicle-use air conditioning device condenser 100 (also shown hereafter as the condenser 100) is used in a refrigerating cycle of a vehicle-use air conditioning device, is configured of an aluminum alloy, and is attached in, for example, an upright state on a front side of a radiator in a vehicle engine room, where the condenser 100 is liable to be exposed to air entering when the vehicle is moving. In this example, the condenser 100 includes a condensing unit A, which causes a high temperature, high pressure gas refrigerant discharged from a compressor to be condensed by causing a heat exchange with air entering when the vehicle is moving (air outside a vehicle cabin) to be carried out, thereby creating a gas/liquid mixture refrigerant, and a supercooling unit B that, after the gas/liquid mixture refrigerant condensed in the condensing unit A is caused to be separated into a gas and a liquid in the liquid receiver 1, supercools the liquid refrigerant.

To describe a structure of a condenser more specifically, the condenser 100 is configured to have a pair of header pipes 101 and 102, a multiple of tubes 103 installed between the header pipes 101 and 102, and a corrugated fin 104 fixed in each gap between tubes.

Each of the header pipes 101 and 102 is formed in an approximately cylindrical form by extrusion molding or by rolling a flat plate form member, and aperture portions formed in either longitudinal direction end portion are blocked off by cap members 101*a*, 101*b*, 102*a*, and 102*b*. Also, partitioning walls 101*c* and 101*d*, which partition an internal space into multiple spaces (for example, three spaces 101*s*1, 101*s*2, and 101*s*3) in the longitudinal direction, are provided in the one header pipe 101, and a partitioning wall 102*c*, which partitions an internal space into multiple spaces (for example, two spaces 102*s*1 and 102*s*2) in the longitudinal direction, is provided in the other header pipe 102. The partitioning wall 101*d* of the one header pipe 101 and the partitioning wall 102*c* of the other header pipe 102 are disposed in positions of the same height, and a heat exchanging unit configured of the tube 103 and the corrugated fin 104 has a portion farther to an upper side than the partitioning walls 101*d* and 102*c* as the condensing unit A, through which a refrigerant including a gaseous phase flows, and has a portion farther to a lower side than the partitioning walls 101*d* and 102*c* as the supercooling unit B, through which a liquid phase refrigerant flows.

The tube 103 is formed in a flattened form by extrusion molding, an interior is divided into a multiple of passages extending in a longitudinal direction, one end portion is inserted into and fixed to the one header pipe 101 at predetermined intervals, and another end portion is inserted into and fixed to the other header pipe 102 at predetermined intervals. Also, a refrigerant inlet 105 that communicates with the space 101*s*1 is provided in a vicinity of an upper end of the one header pipe 101, and a refrigerant outlet 106 that communicates with the space 102*s*2 is provided in a vicinity of a lower end of the other header pipe 102.

Figure 2:
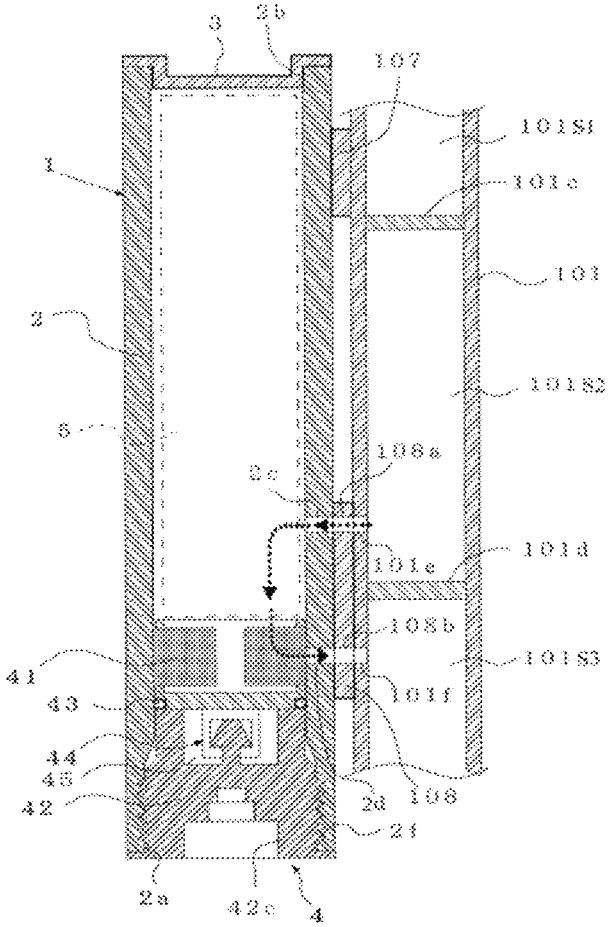
FIG. 2 is a sectional view showing an overall configuration of a liquid receiver fixed to the vehicle-use air conditioning device condenser of FIG. 1.
Figure 3A:
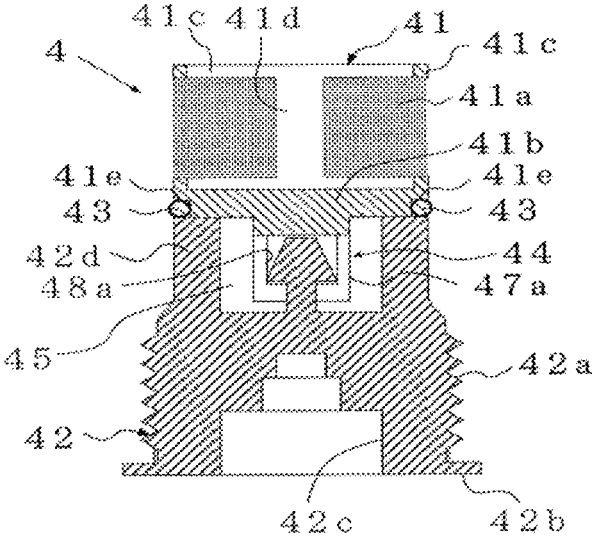
Figure 3B:
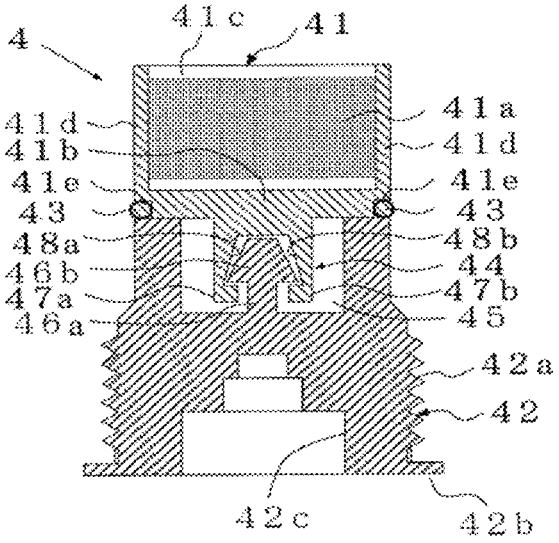
Figure 4A:
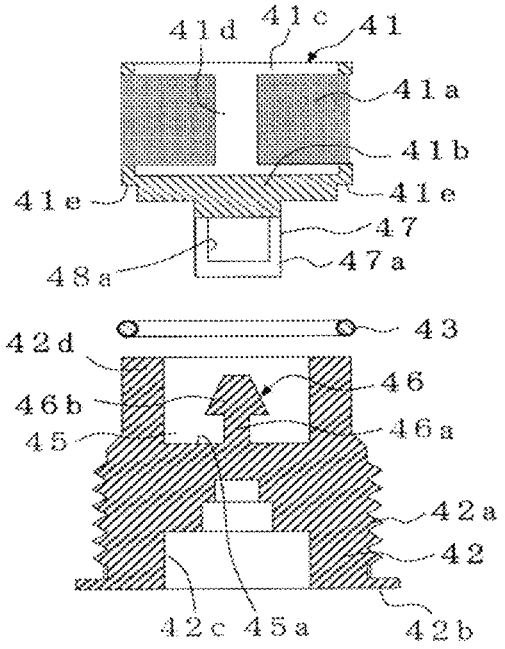
Figure 4B:
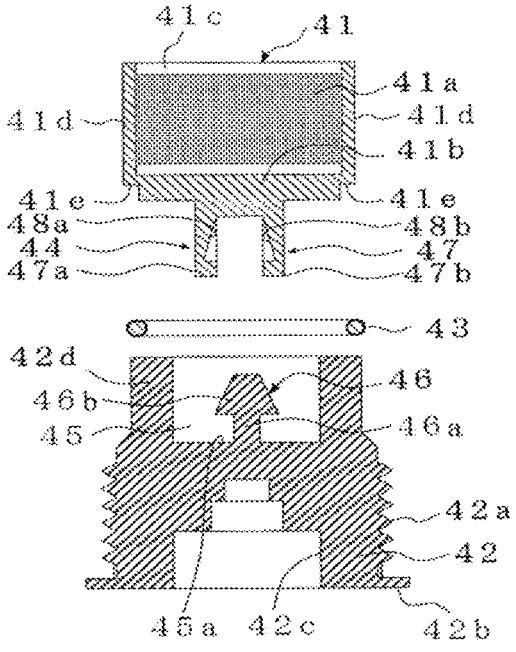

The liquid receiver 1 is fixed by brazing across brackets 107 and 108 in the longitudinal direction of the header pipe 101 to an outer peripheral face of the one header pipe 101 on a side opposite to the side on which the tube 103 is inserted and fixed, as also shown in FIG. 2. An upper side space of the one header pipe 101 meeting with the partitioning wall 101*d* (the space 101*s*2 between the partitioning wall 101*c* and the partitioning wall 101*d*) communicates with an interior of the liquid receiver 1, and sends a refrigerant that has flowed in from the condensing unit A to the liquid receiver 1, and a lower side space meeting with the partitioning wall 101*d* of the one header pipe 101 (the space 101*s*3 between the partitioning wall 101*d* and the cap 101*b*) communicates with the interior of the liquid receiver 1, and sends a refrigerant that has flowed out from the liquid receiver 1 to the supercooling unit B.

The liquid receiver 1 is configured mainly of an aluminum alloy, and includes the liquid receiver main body 2, which is formed in a cylindrical form and stores a refrigerant in an interior thereof, and an upper side aperture portion (an other side aperture portion) 2*b* provided in a longitudinal direction upper side end portion is blocked off by a cap member 3 being fixed by brazing. Also, a lower side aperture portion (a one side aperture portion) 2*a* provided in a longitudinal direction lower side end portion is blocked off by a stopper 4 to be described hereafter. Further, a space between the cap member 3 and the stopper 4 of the liquid receiver main body 2 is filled with a drying agent 5.

A refrigerant outflow hole 101*e* is formed in a side wall in a vicinity of an upper side of the partitioning wall 101*d* of the one header pipe 101, a refrigerant inflow hole 2*c* is formed in a side wall of the liquid receiver main body 2 corresponding to the position of the refrigerant outflow hole 101*e*, the refrigerant outflow hole 101*e* and the refrigerant inflow hole 2*c* correspond via a through hole 108*a* provided in the bracket 108, and a refrigerant that flows into the space 101*s*2 of the one header pipe 101 is sent to the space in the liquid receiver 1 filled with the drying agent 5.

Also, a refrigerant inflow hole 101*f* is formed farther to the lower side than the partitioning wall 101*d* in the side wall of the one header pipe 101, a refrigerant outflow hole 2*d* is formed in the side wall of the liquid receiver main body 2 corresponding to the position of the refrigerant inflow hole 101*f*, and the refrigerant inflow hole 101*f* and the refrigerant outflow hole 2*d* correspond via a through hole 108*b* provided in the bracket 108. The refrigerant outflow hole 2*d* is provided in a position facing a side portion of a filtering unit 41, to be described hereafter, of the stopper 4, because of which a refrigerant that has flowed into the liquid receiver 1 from the header pipe 101 flows out into the space 101*s*3 of the one header pipe 101 that communicates with the supercooling unit B after passing through the drying agent 5 and the filtering unit 41.

As also shown in FIGS. 3A, 3B, 4A, and 4B, the stopper 4 is configured to have the filtering unit 41 through which a refrigerant housed in the interior of the liquid receiver main body 2 passes, a fixed portion 42 that blocks off the lower side aperture portion (the one side aperture portion) 2*a* of the liquid receiver main body 2, a sealing member 43 formed of an O-ring that seals a gap formed by an outer peripheral face of the filtering unit 41 and an inner peripheral face of the liquid receiver main body 2, and a movable connection portion 44 interposed between the filtering unit 41 and the fixed portion 42.

The filtering unit 41 is manufactured by a tubular mesh member 41*a* being insert molded with a resin, a bottom wall 41*b* is formed in such a way as to block off one axial direction end (a lower end) of the mesh member 41*a*, a circular frame 41*c* is provided on an aperture edge of the mesh member 41*a* in such a way that another end (an upper end) is opened, the circular frame 41*c* and the bottom wall 41*b* are joined by a rib 41*d* spanning in the axial direction, and the mesh member 41*a* is exposed except for a portion wherein the rib 41*d* is formed on a peripheral face. Consequently, a refrigerant flows into an inner side of the filtering unit 41 via an aperture portion of the filtering unit 41 (an inner side of the circular frame 41*c*), the flow is changed to a radial direction after colliding with the bottom wall 41*b*, and the refrigerant passes through the mesh member 41*a* and flows out in the radial direction.

The fixed portion 42 is formed in a cylindrical form, and includes on an outer peripheral face a screw portion 42*a* formed of an external thread that screws into an internal thread 2*f* formed on an inner peripheral face of the lower side aperture portion (the one side aperture portion) 2*a* of the liquid receiver main body 2, and a flange portion 42*b* that comes into contact with a peripheral edge of an opened end of the lower side aperture portion 2*a* of the liquid receiver main body 2 (a lower end of the liquid receiver main body 2) is formed integrated with an end edge of the screw portion 42*a*. Also, a tool fitting hole 42*c*, into which a tool that causes the fixed portion 42 to rotate is inserted, is formed in a bottom face of the fixed portion 42. Furthermore, a circular wall 42*d* that is brought into contact with the bottom wall 41*b* of the filtering unit 41 is provided on a side of the fixed portion 42 opposite to that of the flange portion 42*b*.

Further, a bearing face 41*e* formed of a stepped portion that supports the sealing member 43 is formed on a lower face peripheral edge that is the bottom wall 41*b* of the filtering unit 41, and with which a leading end of the circular wall 42*d* comes into contact, and the bearing face 41*e* is caused to support the sealing member 43 and bring the sealing member 43 into contact with the inner peripheral face of the liquid receiver main body 2, whereby a leakage of a refrigerant into the fixed portion 42 from between the filtering unit 41 and the liquid receiver main body 2 (the gap formed by the outer peripheral face of the filtering unit 41 and the inner peripheral face of the liquid receiver main body 2) is prevented.

The movable connection portion 44 is configured to have an engagement projection 46, which is provided upright in a center of a bottom face 45*a* of a connection concavity 45 enclosed by the circular wall 42*d* of the fixed portion 42, and an engagement receiving portion 47, which protrudes downward from the bottom wall 41*b* of the filtering unit 41 and engages with the engagement projection 46 in such a way as to be able to rotate relatively.

The engagement projection 46 is configured of a cylindrical shaft portion 46*a* protruding from the bottom face 45*a* of the connection concavity 45, and an engagement portion 46*b* of a truncated cone form provided integrated with a leading end of the shaft portion 46*a* in such a way that a diameter is expanded.

The engagement receiving portion 47 has a pair of engagement arms 47*a* and 47*b* that extend downward from the bottom wall portion 41*b* of the filtering unit 41. The pair of engagement arms 47*a* and 47*b* are opposed across an interval that is an interval greater than the diameter of the shaft portion 46*a* of the engagement projection 46 and smaller than a diameter of a bottom face of the engagement portion 46*b*, and engagement recessed portions 48*a* and 48*b* that conform to a form of the engagement portion 46*b* are formed in faces opposing each other.

This means that when the engagement portion 46*b* of the engagement projection 46 is pushed from a leading end thereof between the pair of engagement arms 47*a* and 47*b* of the engagement receiving portion 47, the engagement arms 47*a* and 47*b* are elastically pushed apart by an outer peripheral face of the engagement portion 46*b*, and when a whole of the engagement portion 46*b* is pushed as far as an end of the space between the pair of engagement arms 47*a* and 47*b*, the pair of engagement arms 47*a* and 47*b* return to the original form owing to their own resilience (this includes not only an aspect wherein the form is restored completely, but also an aspect wherein the form is restored to an extent such that the pair of engagement arms 47*a* and 47*b* are also elastically pushed apart), and the engagement portion 46*b* is in a state of being engaged with the engagement recessed portions 48*a* and 48*b* in such a way as to rotate freely.

Also, in a state wherein this kind of engagement projection 46 is engaged with the engagement receiving portion 47, a leading end of the circular wall 42*d* of the fixed portion 42 comes into contact with the bottom wall 41*b* of the filtering unit 41, or is positioned in a vicinity thereof, and the sealing member 43 does not become detached from the bearing face 41*e* when the stopper 4 is attached to the liquid receiver main body 2. In order to ensure that the sealing member 43 does not become detached from the bearing face 41*e*, a diameter of an outer periphery of the circular wall 42*d* is greater than a diameter of the bearing face 41*e*.

Figure 5A:
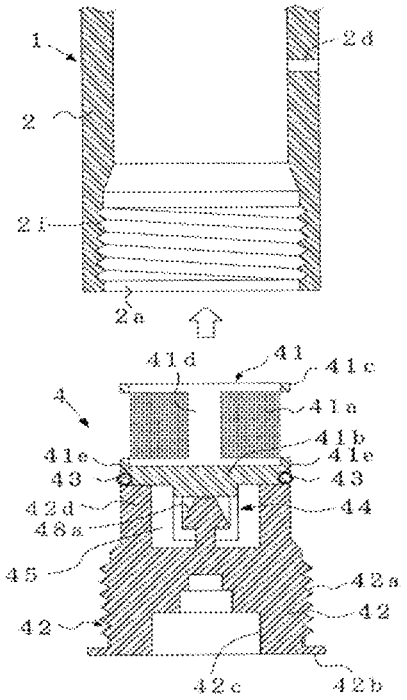
Figure 5B:
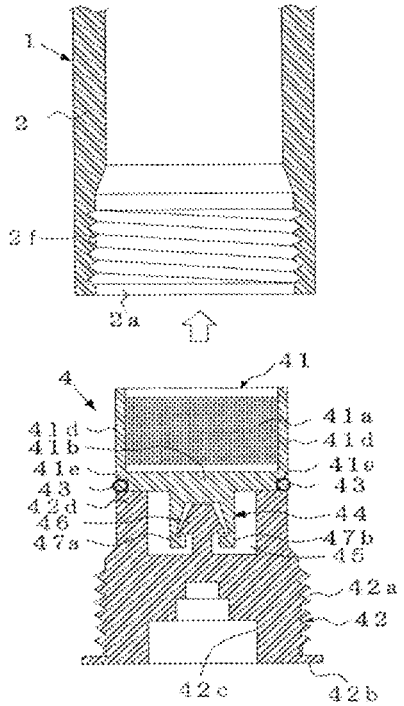
Figure 6A:
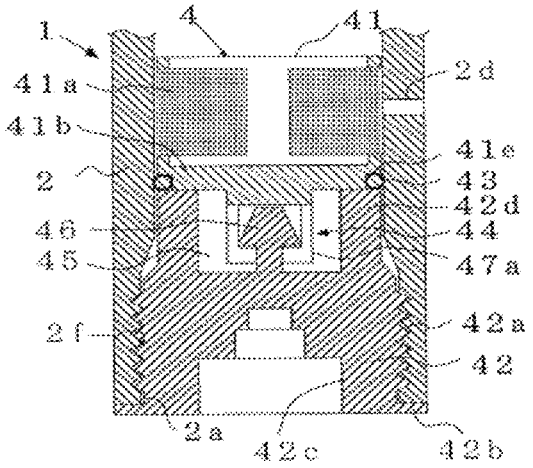
Figure 6B:
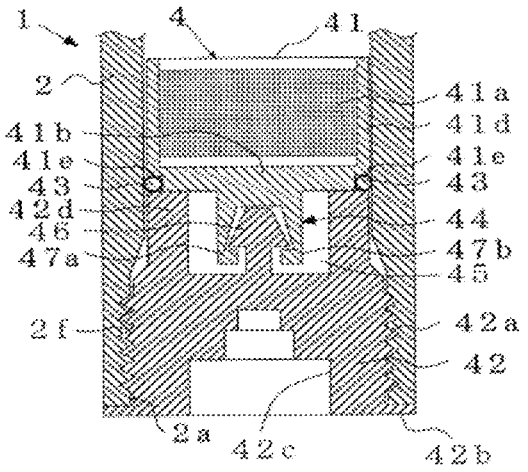

Further, in order to attach the stopper 4, wherein the filtering unit 41 is connected to the fixed portion 42 via the movable connection portion 44 in such a way as to be able to rotate, to the lower side aperture portion 2*a* of the liquid receiver main body 2, the stopper 4 is inserted from the filtering unit 41 and pushed into the lower side aperture portion 2*a* of the liquid receiver main body 2, as shown in FIGS. 5A and 5B. Thereupon, the filtering unit 41 passes the internal thread 2*f* formed on an inner face of the opened end portion of the liquid receiver main body 2, and is inserted in the axial direction along the inner peripheral face of the liquid receiver main body 2 continuous with the internal thread 2*f*. Further, after the screw portion 42*a* of the fixed portion 42 approaches the internal thread 2*f* of the liquid receiver main body 2, a tool is inserted into the tool fitting hole 42*c* formed in the bottom face of the fixed portion 42, the fixed portion 42 is caused to rotate, and the stopper 4 is screwed in until the flange portion 42*b* comes into contact with the liquid receiver main body 2, as shown in FIGS. 6A and 6B.

Thereupon, although the sealing member 43 moves in the axial direction in a state pressed between the inner wall of the liquid receiver main body 2 and the filtering unit 41 in this process, the movable connection portion 44 is linking the filtering unit 41 and the fixed portion 42 in such a way as to rotate freely, because of which the filtering unit 41 is prevented from rotating with respect to the liquid receiver main body 2 by a frictional force between the sealing member 43 and the inner peripheral face of the liquid receiver main body 2, and by a frictional force between the sealing member 43 and the bottom wall 41*b* of the filtering unit 41.

In this way, the movable connection portion 44 is linking the filtering unit 41 with the fixed portion 42 in such a way as not to cause the filtering unit 41 to follow a rotation of the fixed portion 42, and in such a way as to cause the filtering unit 41 to follow an axial direction movement of the fixed portion 42, because of which the sealing member 43 is not forcibly rotated in a state pressed against the inner wall of the liquid receiver main body 2, and there is no longer a problem of a surface of the sealing member 43 being damaged, or a problem of causing uneven distortion to occur in a circumferential direction in the sealing member 43. Because of this, high airtightness provided by the sealing member 43 can be maintained. Also, the diameter of the bottom face of the engagement portion 46*b* of the engagement projection 46 is greater than the interval between the opposing engagement arms 47*a* and 47*b*, meaning that when removing the stopper 4 from the liquid receiver main body 2 by causing the fixed portion 42 to rotate, the filtering unit 41 can be moved toward the lower side aperture portion 2*a* by the engagement projection 46, and the filtering unit 41 can be prevented from remaining in the liquid receiver main body 2.

Herein, the filtering unit 41 and the engagement receiving portion 47 (the engagement arms 47*a* and 47*b*) of the movable connection portion 44 formed integrated with the filtering unit 41 are, for example, injection molded using the kinds of die shown in FIGS. 7A to 7D and FIGS. 8A to 8D.

Dies used here include a fixed die 51 that shapes external forms of the filtering unit 41 and the engagement arms 47*a* and 47*b*, a movable die 52 that shapes an inner side form of the filtering unit 41, a sliding die 53 that shapes a side face aperture portion of the filtering unit 41, and a loose piece 54 and a pull-out core 55 that form opposing faces of the pair of engagement arms 47*a* and 47*b*, A filtering unit forming recessed portion 51*a* that forms the filtering unit 41, and a core housing hole 51*b* formed to be continuous with a center of the filtering unit forming recessed portion 51*a*, are provided in the fixed die 51. Also, a bearing face forming stepped portion 51*c* that forms the bearing face 41*e* supporting the sealing member 43 is formed in the filtering unit forming recessed portion 51*a* in a portion separated from a portion wherein dies come into contact (a partitioning line P between the fixed die 51 and the movable die 52 and sliding die 53) (in this example, a portion farther to a lower side of the drawing than an interface with the sliding die 53).

Figure 9:
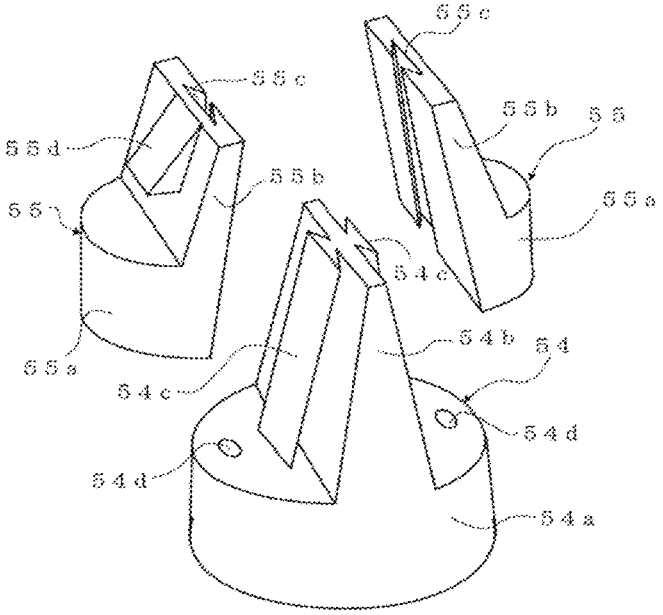
FIG. 9 is a perspective view showing a loose piece and a pull-out core that form the engagement arms of the movable connection portion.

The loose piece 54 and the pull-out core 55 are configured by a pair of pull-out cores 55 being attached in such a way as to be able to slide and in such a way as to sandwich the loose piece 54, as also shown in FIG. 9, and are disposed in the core housing hole 51*b* of the fixed die 51.

The loose piece 54 is fixed in a predetermined place in the core housing hole 51*b*, and includes a cylindrical portion 54*a*, which is formed in accordance with an inner diameter of the core housing hole 51*b*, and a guide wall 54*b*, which includes a central shaft of the cylindrical portion 54*a* and is formed to have a width the same as a diameter of the cylindrical portion 54*a*, wherein the guide wall 54*b* is formed to become gradually thinner as the guide wall 54*b* becomes distanced from the cylindrical portion 54*a* (both side faces of the guide wall 54*b* are formed in such a way as to incline with respect to an axial center), and an engagement ridge 54*c* that extends in an axial direction is provided on both side faces of the guide wall 54*b*.

The pull-out core 55 is attached in such a way as to slide freely to both side faces of the guide wall 54 of the loose piece 54, is formed to have a width and a height of the same extent as those of the guide wall 54*b*, comes into contact with the cylindrical portion 54*a* of the loose piece 54 in a state assembled with the loose piece 54 in such a way as to cause an upper end to coincide with an upper end of the guide wall 54*b*, and includes a semi-cylindrical portion 55*a* that comes into contact with an inner peripheral face of the core housing hole 51*b* in such a way as to be able to slide, and a sliding wall portion 55*b* disposed extending diagonally upward from the semi-cylindrical portion 55*a*. An engagement groove 55*c* that engages with the engagement ridge 54*c* in such a way as to be able to slide is formed in a face of the sliding wall portion 55*b* opposing the guide wall 54*b*, and a recessed portion forming projection 55*d* that forms the engagement recessed portions 48*a* and 48*b* of the engagement arms 47*a* and 47*b* is provided on a back face of the sliding wall portion 55*b*.

Also, a through hole 54*d* through which an ejector pin 56 is inserted is formed on both sides of the guide wall 54*b* of the cylindrical portion 54*a* of the loose piece 54. The ejector pin 56 is inserted through the through hole 54*d*, one end is brought into contact with the semi-cylindrical portion 55*a* of the pull-out core 55, and another end is connected to a lifting plate 58 disposed below the loose piece 54 with a compression spring 57 interposed between the two.

Figure 7A:
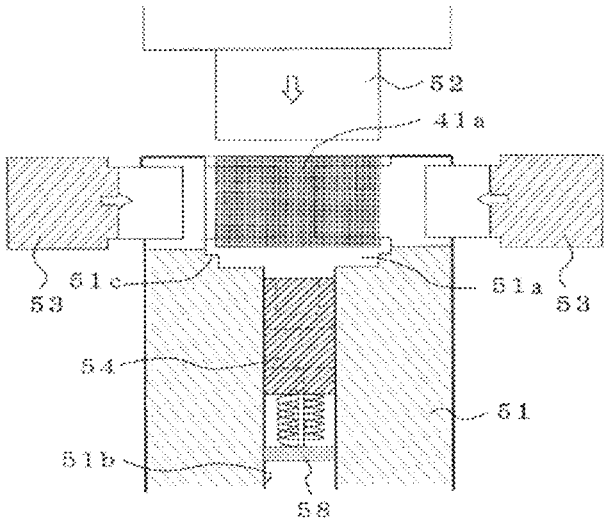
Figure 8A:
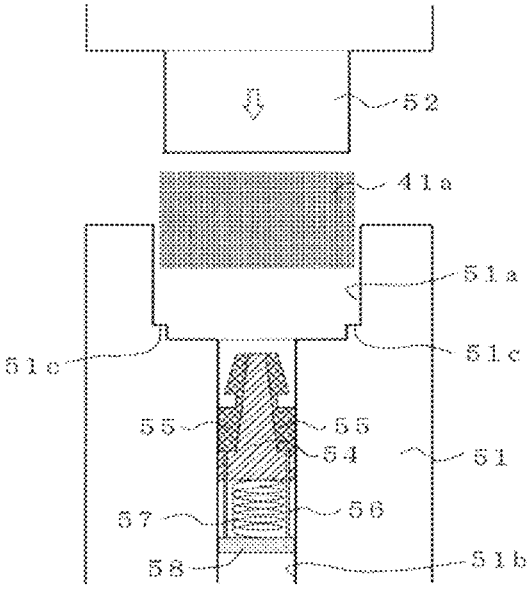

The heretofore described configuration is such that in order to form the filtering unit 41 and the engagement arms 47*a* and 47*b* formed integrated with the filtering unit 41, the pull-out core 55 is assembled with the loose piece 54, and a state wherein the semi-cylindrical portion 55*a* of the pull-out core 55 is brought into contact with the cylindrical portion 54*a* of the loose piece 54 by a biasing force of the compression spring 57 is adopted, as shown in FIGS. 7A and 8A. Also, the mesh member 41*a* is disposed in the filtering unit forming recessed portion 51*a* of the fixed die 51 before the die is clamped.

Figure 7B:
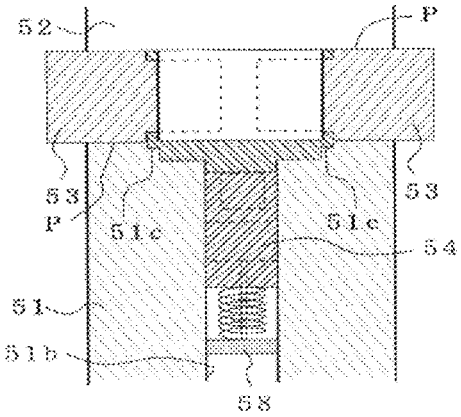
Figure 8B:
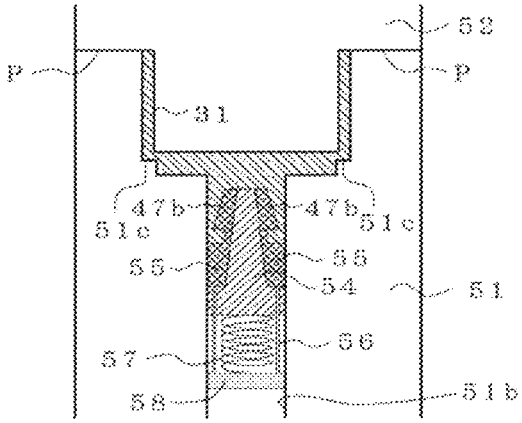

Further, in this state, the movable die 52 is caused to move toward the fixed die 51, and the sliding die 53 is caused to move toward the filtering unit forming recessed portion 51*a*, thereby clamping the die, as shown in FIGS. 7B and 8B. Further, a molten resin is injected from an unshown gate into a cavity portion enclosed by the dies.

Figure 7C:
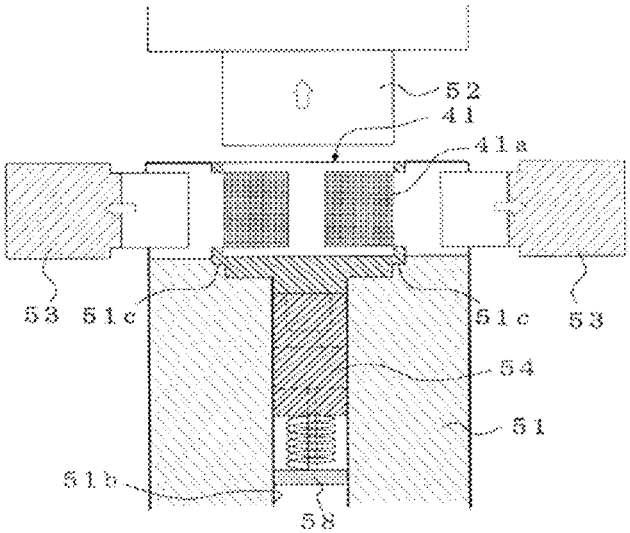
Figure 7D:
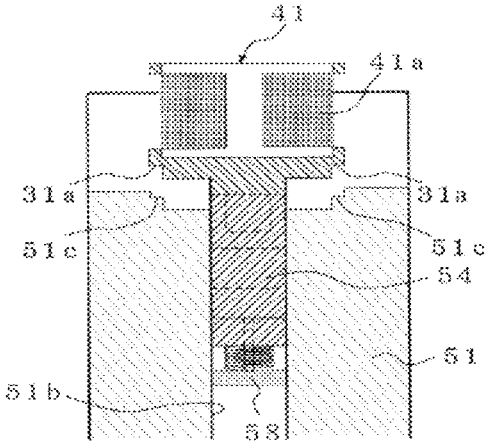
Figure 8C:
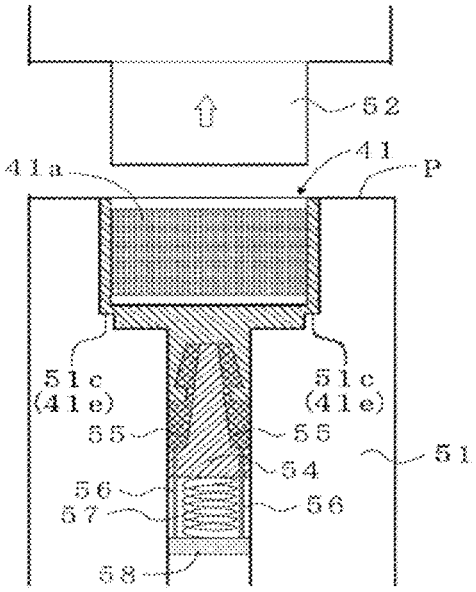
Figure 8D:
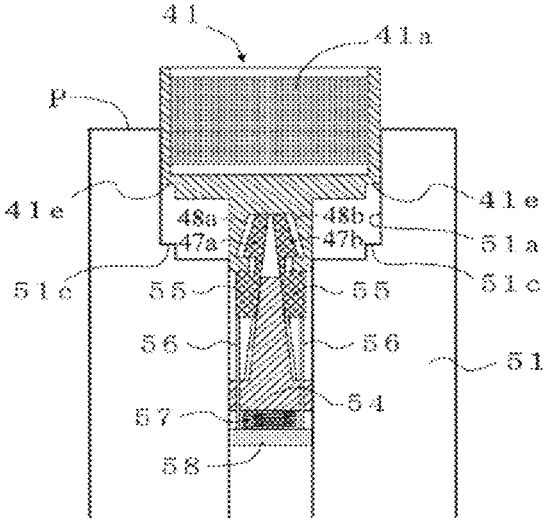

Subsequently, after the resin is cured, the movable die 52 and the sliding die 53 are separated, as shown in FIGS. 7C and 8C. By so doing, the filtering unit 41, wherein an inner side of the mesh member 41*a* and a portion not covered by the sliding die 53 are integrated by the resin, is formed.

Subsequently, the lifting plate 58 is pressed upward, whereby the pull-out core 55 is pressed upward by the ejector pin 56. Thereupon, the pair of pull-out cores 55 approach each other while being pressed upward, meaning that when the recessed portion forming projection 55*d* separates from the engagement recessed portions 48*a* and 48*b* of the engagement arms 47*a* and 47*b*, the filtering unit 41*a* can be removed from the fixed die 51 together with the engagement receiving portion 47 (the engagement arms 47*a* and 47*b*).

Also, the bearing face 41*e* of the filtering unit 41 to which the sealing member 43 is attached is formed in the bearing face forming stepped portion 51*c* of the filtering unit forming recessed portion 51*a* of the fixed die 51, and is formed in a position deviating from the partitioning line P of the dies (the fixed die 51, the movable die 52, and the sliding die 53) that mold the filtering unit 41, because of which there is no problem of burr occurring on the bearing face 41*e*, and bearing face molding accuracy can be secured. This means that when the sealing member (O-ring) 43 is brought into contact with the bearing face, there is no damage to the sealing member 43, and a sealing performance can be maintained.

Figure 10A:
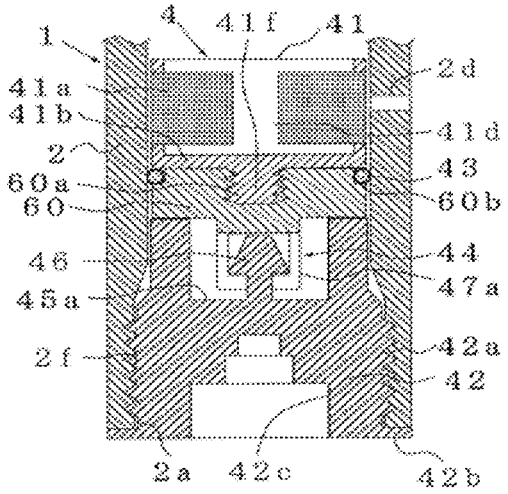
Figure 10B:
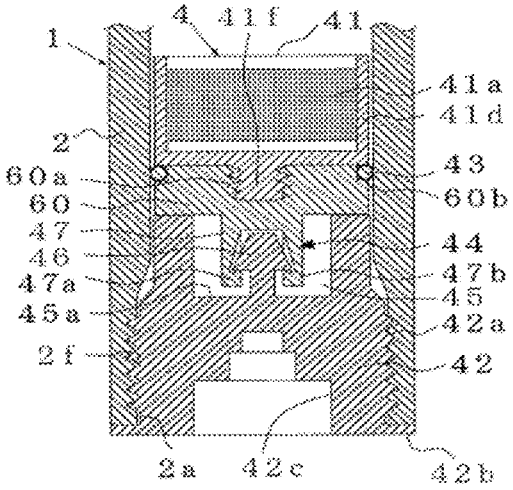

With regard to the heretofore described configuration, an example wherein the filtering unit 41 and the fixed portion 42 are connected by the movable connection portion 44 has been shown, but as shown in FIGS. 10A and 10B, the stopper 4 may be such that an intermediate portion 60 is provided between the filtering unit 41 and the fixed portion 42, the intermediate portion 60 is fixed to the filtering unit 41 and linked to the fixed portion 42 via the movable connection portion 44, and the sealing member 43, which comes into contact with the liquid receiver main body 2, is provided between the filtering unit 41 and the intermediate portion 60.

The intermediate portion 60 is such that an internal thread 60*a* is formed in an axial direction in an upper face thereof (a face opposing the bottom wall 41*b* of the filtering unit 41), and the intermediate portion 60 is fixed to the filtering unit 41 by an external thread 41*f* provided projecting from the bottom wall 41*b* of the filtering unit 41 being screwed into the internal thread 60*a*.

Also, the engagement receiving portion 47 (the engagement arms 47*a* and 47*b*), which protrudes toward the connection concavity 45, is formed on a lower face (a face opposing the fixed portion 42 and the connection concavity 45) of the intermediate portion 60.

Further, the O-ring 43 is supported by a bearing face 60*b* provided on a peripheral edge of the upper face of the intermediate portion 60 (a peripheral edge of the face that comes into contact with the bottom wall 41*b* of the filtering unit 41), and seals a space between the intermediate portion 60 and the liquid receiver main body 2.

As other configurations are the same as the configurations shown in FIGS. 6A and 6B, identical reference signs are allotted to identical places, and a description will be omitted.

This configuration is such that the filtering unit 41 is linked to the fixed portion 42 via the intermediate portion 60, and moreover, the sealing member 43 is disposed between the intermediate portion 60, on which a rotational force when screwing in the fixed portion 42 does not act at all, and the filtering unit 41, because of which there is no longer a problem of the sealing member 43 being damaged, or a problem of uneven distortion occurring in the circumferential direction in the sealing member 43, and a high sealing performance can be secured.

Figure 11A:
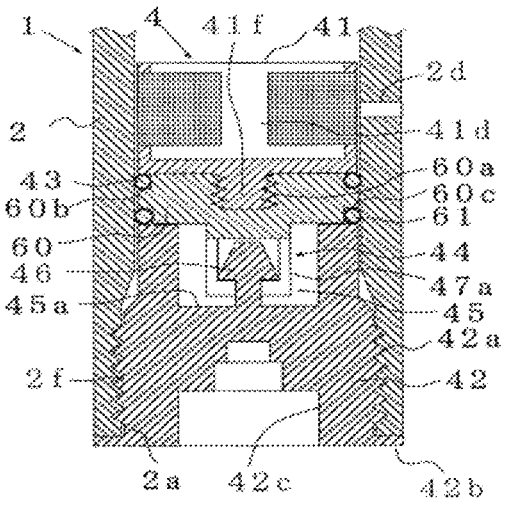
Figure 11B:
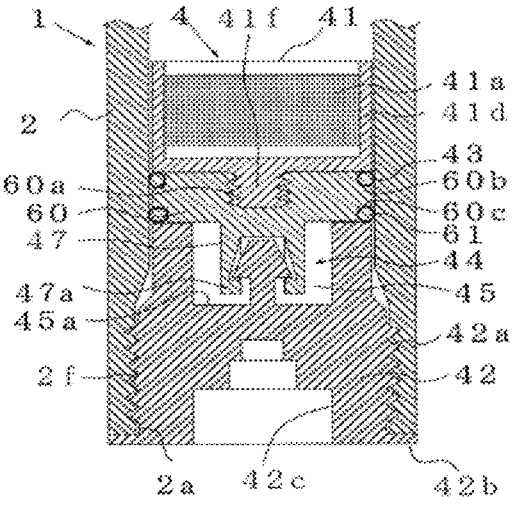

A modification of FIGS. 10A and 10B is shown in FIGS. 11A and 11B. In this example, another sealing member 61, which prevents a leakage of a refrigerant to the fixed portion 42 from between the intermediate portion 60 and the liquid receiver main body 2 by being brought into contact with the inner peripheral face of the liquid receiver main body 2, is further provided, and the other sealing member is supported by a bearing face 60*c* provided on a peripheral edge of the lower face (a peripheral edge of the face that comes into contact with the circular wall 42*d* of the fixed portion 42) of the intermediate portion 60, and seals a space between the intermediate portion 60 and the liquid receiver main body 2.

This kind of configuration is such that in addition to the sealing member 43, on which a rotational force when screwing in the fixed portion 42 does not act at all, being disposed between the intermediate portion 60 and the filtering unit 41, the other sealing member 61, which is brought into contact with the inner peripheral face of the liquid receiver main body 2, is also disposed between the intermediate portion 60 and the fixed portion 42, because of which the sealing performance can be further improved.

The intermediate portion 60 and the engagement arms 47*a* and 47*b* of the movable connection portion 44 formed integrated with the intermediate portion 60 are, for example, injection molded using the kinds of die shown in FIGS. 12A to 12D.

Dies used here include a fixed die 71 that shapes external forms of a lower side half of the intermediate portion 60 and the engagement arms 47*a* and 47*b*, a relay die that shapes an upper side half of the intermediate portion 60, a core die 73 on whose outer peripheral face a thread is engraved, and the loose piece 54 and pull-out core 55 that form opposing faces of the pair of engagement arms 47*a* and 47*b*.

An intermediate portion-use recessed portion 71*a* that forms a lower half of the intermediate portion 60, and a core housing hole 71*b* formed to be continuous with a center of the intermediate portion-use recessed portion 71*a*, are provided in the fixed die 71. Also, a bearing face forming stepped portion 71*c* that forms the bearing face 60*c* supporting the other sealing member 61 is formed in the intermediate portion recessed-use portion 71*a* in a portion separated from an interface with the relay die 72 (a partitioning line P between the fixed die 71 and the relay die 72) (in this example, a portion farther to a lower side of the drawing than the interface).

An intermediate portion-use recessed portion 72*a* that forms an upper half of the intermediate portion 60, and a through hole 72*b* through which the core die 73 is inserted, are provided in the relay die 72. Also, a bearing face forming stepped portion 72*c* that forms the bearing face 60*b* supporting the sealing member 43 is formed in the intermediate portion-use recessed portion 72*a* in a portion separated from an interface with the fixed die 71 (a partitioning line P between the fixed die 71 and the relay die 72) (in this example, a portion farther to an upper side of the drawing than the interface).

The loose piece 54 and the pull-out core 55 being of the same configuration as in FIG. 9, a pair of pull-out cores 55 are attached to the loose piece 54 in such a way as to be able to slide, and are disposed in the core housing hole 71*b*.

Figure 12A:
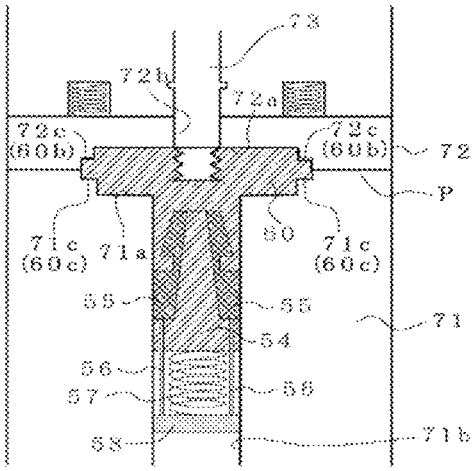

The heretofore described configuration is such that in order to form the intermediate portion 60 and the engagement arms 47*a* and 47*b* formed integrated with the intermediate portion 60, the pull-out core 55 is assembled with the loose piece 54, and a state wherein the pull-out core 55 is brought into contact with the cylindrical portion of the loose piece 54 by a biasing force of the compression spring 57 is adopted, as shown in FIG. 12A.

In this state, the die is clamped in such a way as to obtain a state wherein the relay die 72 is caused to abut the fixed die 71, and the portion of the core die 73 in which the thread is engraved is caused to protrude into a cavity portion that forms the intermediate portion 60. Further, a molten resin is injected from an unshown gate into a cavity portion enclosed by the dies.

Figure 12B:
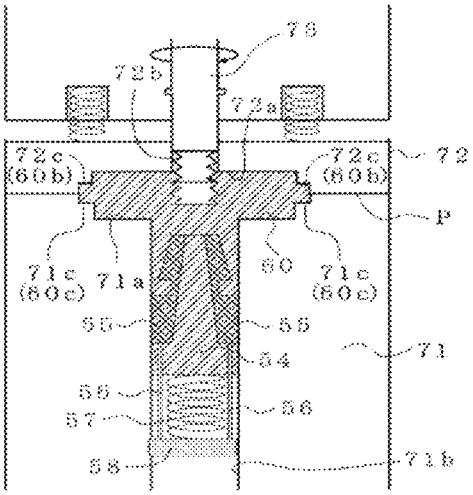
Figure 12C:
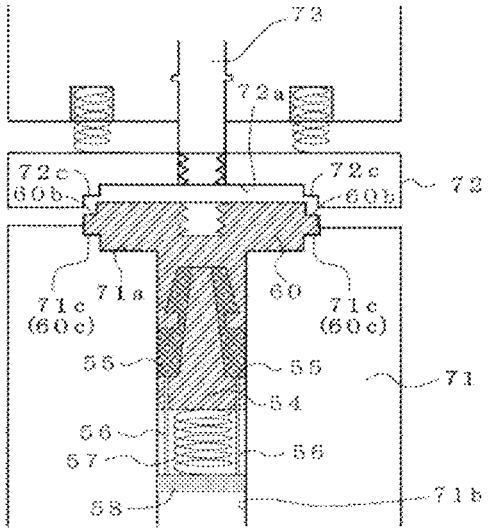

After the resin is cured, the core die 73 is pulled out while being caused to rotate, and the portion of the core die 73 in which the thread is engraved is removed from the intermediate portion 60, as shown in FIG. 12B. By so doing, the internal thread 60*a* is molded in the intermediate portion 60. Subsequently, the relay die 72 is removed together with the core die 73, as shown in FIG. 12C.

Figure 12D:
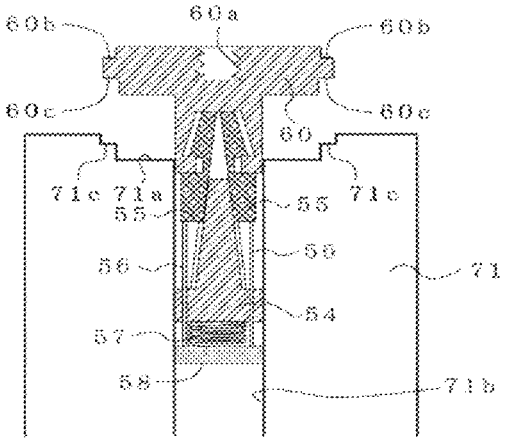

Subsequently, as shown in FIG. 12D, the lifting plate is pressed upward, whereby the pull-out core 55 is pressed upward by the ejector pin 56, and when the recessed portion forming projection 55*d* of the pull-out core 55 is removed from the engagement recessed portions 48*a* and 48*b* of the engagement arms 47*a* and 47*b*, the engagement arms 47*a* and 47*b* can be removed from the fixed die 71 together with the intermediate portion 60.

Also, as the two bearing faces 60*b* and 60*c* of the intermediate portion 60 to which the sealing members are attached are formed in positions deviating from the partitioning line P of the dies that mold the intermediate portion 60 (the fixed die 71 and the relay die 72), there is no problem of burr occurring on the molded bearing faces, and molding accuracy can be secured. This means that when the sealing members 43 and 61 are caused to be supported by the bearing faces 60*b* and 60*c*, there is no damage to the sealing members 43 and 61, and a high sealing performance can be secured.

Figure 13A:
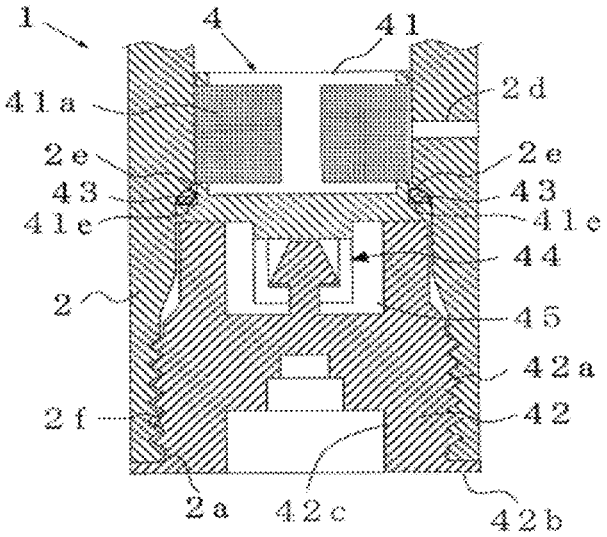
Figure 13B:
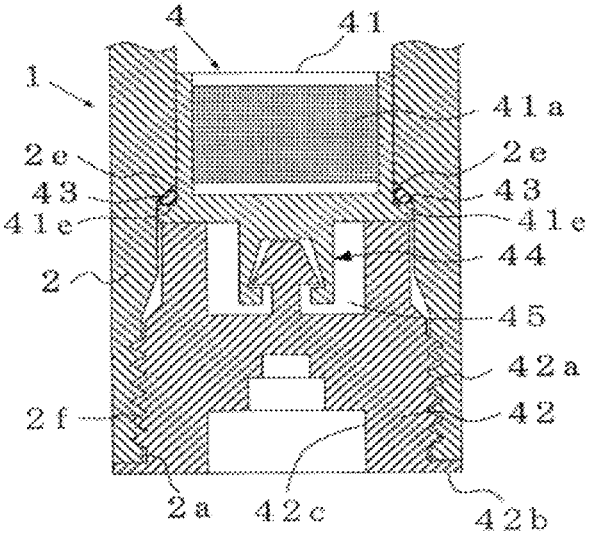

Another sealing structure of the stopper 4 is shown in FIGS. 13A and 13B. In this example, a method whereby the sealing member 43 is brought into contact with the inner peripheral face of the liquid receiver main body 2 differs from that of FIGS. 6A and 6B. That is, the bottom wall 41*b* of the filtering unit 41 is caused to protrude to a radial direction outer side, the bearing face 41*e* is formed and caused to support the sealing member 43 on a side of the portion caused to protrude opposite to a side with which the fixed portion 42 comes into contact, and the sealing member 43 comes into contact with a stepped portion 2*e* formed on the inner peripheral face of the liquid receiver main body 2, and is compressed in the axial direction.

Herein, the stepped portion 2*e* may be formed to be perpendicular to the inner peripheral face of the liquid receiver main body 2, but in this example, the stepped portion 2*e* is formed to have a taper such that an inner peripheral face broadens toward the lower side aperture portion 2*a*.

Consequently, in this example, the sealing member 43 can be compressed in the axial direction, because of which a high sealing performance can be secured by increasing a fastening force of the stopper 4.

The heretofore described sealing structure that compresses in the axial direction may be utilized in the stopper 4 that has the intermediate portion 60. For example, as opposed to the configuration of FIGS. 10A and 10B, a configuration may be such that the intermediate portion 60 is caused to protrude to a radial direction outer side (a diameter of the filtering unit 41 is smaller than that of the intermediate portion 60), a bearing face 60*d* is formed and caused to support the sealing member 43 on the portion caused to protrude, and the sealing member 43 is brought into contact with the stepped portion 2*e* formed on the inner peripheral face of the liquid receiver main body 2, and is compressed in the axial direction, as shown in FIGS. 14A and 14B.

Figure 14A:
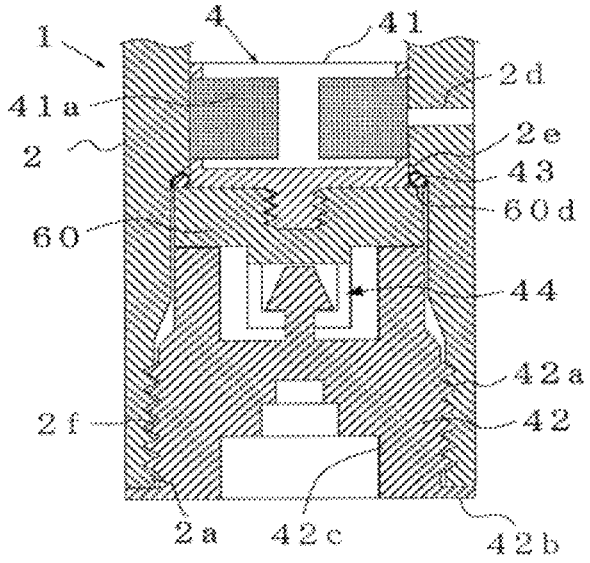
Figure 14B:
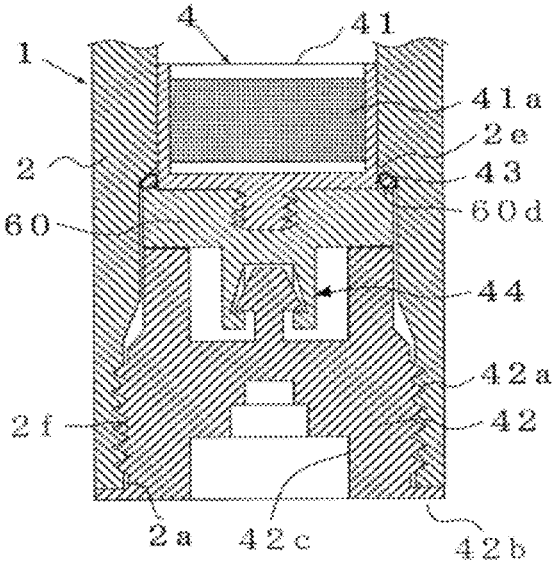
Figure 15A:
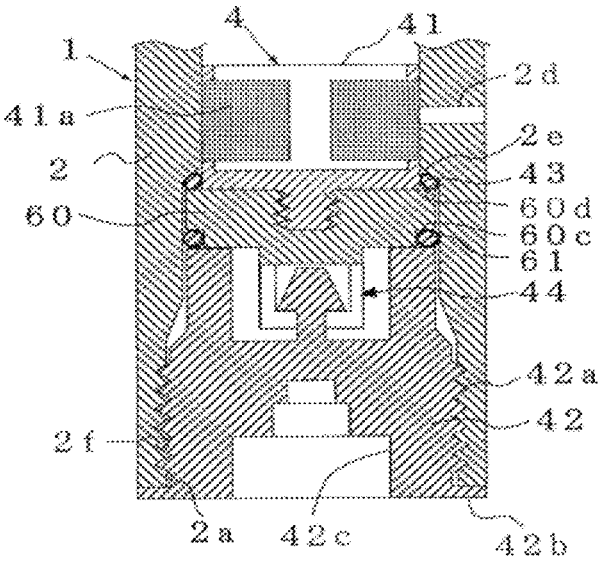
Figure 15B:
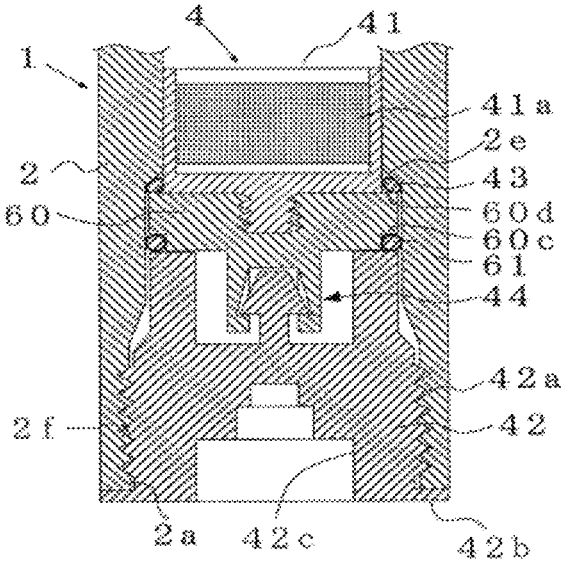

Also, as opposed to the configuration of FIGS. 14A and 14B, the other bearing face 60*c* that supports the other sealing member 61 may be included in the intermediate portion 60, as shown in FIGS. 15A and 15B. As the other sealing member 61 is disposed in addition to the sealing member 43, the sealing performance can be further improved.

In these examples too, the stepped portion 2*e* may be formed to be perpendicular to the inner peripheral face of the liquid receiver main body 2, or may be formed to have a taper, as shown in the drawings.

These configurations are also such that the sealing performance can be improved by increasing the fastening force of the stopper 4, in the same way as in FIGS. 13A and 13B.

DESCRIPTION OF REFERENCE NUMERALS AND SIGNS

1: liquid receiver
2: liquid receiver main body

2*a*: lower side aperture portion (one side aperture portion)
2*b*: upper side aperture portion (other side aperture portion)
2*e*: stepped portion
4: stopper
41: filtering unit
42: fixed portion
42*a*: screw portion
43: sealing member
44: movable connection portion
41*e*, 60*b*, 60*c*: bearing face
51: fixed die
52: movable die
53: sliding die
54: loose piece
55: pull-out core
60: intermediate portion
100: condenser
P: partitioning line

What is claimed is:

1. A liquid receiver, comprising:

a liquid receiver main body that is formed in a tubular form and stores a refrigerant in an interior; and a stopper that is inserted into a one side aperture portion provided in a one side end portion in a longitudinal direction of the liquid receiver main body, thereby blocking off the one side aperture portion, wherein the stopper includes a filtering unit that is housed in the interior of the liquid receiver main body and through which the refrigerant passes, a fixed portion that includes on an outer peripheral face thereof a screw portion that is screwed into an inner peripheral face of the one side aperture portion of the liquid receiver main body, a sealing member that is brought into contact with an inner peripheral face of the liquid receiver main body, thereby preventing a leakage of a refrigerant to the fixed portion from between the filtering unit and the liquid receiver main body, and a movable connection portion that is provided between the filtering unit and the fixed portion and links the filtering unit to the fixed portion in such a way that the filtering unit is not caused to follow a rotation of the fixed portion, and in such a way that the filtering unit is caused to follow an axial direction movement of the fixed portion, wherein the filtering unit is an injection molded article, and has a bearing face that supports the sealing member, and the bearing face is formed in a position deviating from a partitioning line of dies that mold the filtering unit.

2. The liquid receiver according to claim 1, wherein the stopper has an intermediate portion between the filtering unit and the fixed portion, the intermediate portion is fixed with respect to the filtering unit and is linked to the fixed portion via the movable connection portion, and the sealing member is provided between the filtering unit and the intermediate portion.

3. The liquid receiver according to claim 2, wherein the stopper further includes another sealing member that is brought into contact with the inner peripheral face of the liquid receiver main body, thereby preventing a leakage of a refrigerant to the fixed portion from between the intermediate portion and the liquid receiver main body, and the other sealing member is provided between the intermediate portion and the fixed portion.

4. The liquid receiver according to claim 3, wherein the intermediate portion is an injection molded article, and has a bearing face that supports the sealing member and another bearing face that supports the other sealing member, and the bearing face and the other bearing face are formed in positions deviating from a partitioning line of dies that mold the intermediate portion.

5. The liquid receiver according to claim 1, wherein the sealing member comes into contact with a stepped portion formed on the inner peripheral face of the liquid receiver main body, and is compressed in an axial direction.

6. The liquid receiver according to claim 5, wherein the stepped portion is configured to have a tapered face.

7. A vehicle-use air conditioning device condenser including the liquid receiver according to claim 1.

* * * * *